US005732889A

United States Patent [19]

Sasao

[11] Patent Number: 5,732,889

[45] Date of Patent: Mar. 31, 1998

[54] ELECTROMAGNETIC FUEL INJECTION VALVE ASSEMBLY

[75] Inventor: Isamu Sasao, Kakuda, Japan

[73] Assignee: Keihin Seiki Mfg. Co., Ltd., Tokyo, Japan

[21] Appl. No.: 652,263

[22] Filed: May 23, 1996

[30] Foreign Application Priority Data

May 10, 1996 [JP] Japan ..... 8-141091

[51] Int. Cl.[6] ..... F02M 51/00; B05B 1/30

[52] U.S. Cl. ..... 239/585.4; 239/585.1

[58] Field of Search ..... 239/585.1, 585.4, 239/585.5; 251/129.21

[56] References Cited

U.S. PATENT DOCUMENTS 4,385,339 5/1983 Takada et al. ..... 239/585.4 X

*Primary Examiner*—Lesley D. Morris

*Attorney, Agent, or Firm*—Cushman Darby & Cushman; Intellectual Property Group of Pillsbury; Madison & Sutro LLP

[57] ABSTRACT

A fuel injection valve assembly has a construction less expensive in production and applicable for automated assembling. A cylindrical stem portion of a movable core is movably arranged within a movable core guide bore with opposing the rear end thereof with a tip end of a cylindrical core portion of a stationary core and opposing a conical valve head portion to a valve seat. A movable core spring is arranged between the movable core and an inner collar which is arranged within a fuel passage of the housing in pre-loaded fashion. A valve head portion is seated on the valve seat and a gap corresponding to a fully open stroke of said movable core is defined between the rear end of the movable core and the tip end of the cylindrical core portion.

10 Claims, 8 Drawing Sheets

ELECTROMAGNETIC FUEL INJECTION VALVE ASSEMBLY

BACKGROUND OF THE INVENTION

1. Field of the Invention

The present invention relates generally to a fuel injection valve assembly to be employed in a fuel injection system for an internal combustion engine for an automotive vehicle and so forth.

2. Description of the Related Art

Japanese Unexamined Patent Publication (Kokai) No. Showa 59-136560 discloses a conventional electromagnetic fuel injection valve assembly. The electromagnetic fuel injection valve assembly, as disclosed in the above-identified publication, is illustrated in FIG. 9. In the discussion given hereinafter, the electromagnetic fuel injection valve will be simply referred to as a fuel injection valve. For the purpose of disclosure, the upper side in the drawing will be referred to as rear side and the lower side will be referred to as front side.

The reference numeral 70 denotes a housing which is formed with a large diameter flange receptacle bore 70C located in the vicinity of a rear end 70A. A coil bobbin receptacle bore 70E is defined at front side of a shoulder 70D of the flange receptacle bore 70C. The coil bobbin receptacle bore 70E is continuously formed with a smaller diameter movable core guide bore 70G via a shoulder 70F. A valve seat 70J is defined at the radially inner end of a shoulder 70H extending from the movable core guide bore 70G. A fuel injection cavity 70K extending to a tip end 70B is defined at the front side of the valve seat 70J.

The flange receptacle bore 70C, the coil bobbin receptacle bore 70E, the movable core guide bore 70G and the fuel injection cavity 70K are coaxially formed within the housing 70 in axial alignment. Furthermore, an injection aperture 70L is formed to extend from the fuel injection cavity 70G to the tip end 70B. At the axially intermediate portion of the movable core guide bore 70G there is an annular groove 70M having greater diameter than that of the movable core guide bore 70G.

Reference numeral 71 denotes a stationary core the construction of which is described below. Reference numeral 71A denotes an annular flange portion radially extending from a core body of the stationary core 71 and engaging with the flange receptacle bore 70C. A fuel introducing cylindrical portion 71B is formed at the rear side of the annular flange portion 71A. A cylindrical core portion 71C is formed in the core body and extending to the tip end 71E of the stationary core 71.

Reference numeral 72 denotes a coil bobbin which is constructed as set out below. Reference numeral 72A denotes a cylindrical portion formed into a cylindrical-shaped configuration. At the rear end of the cylindrical portion 72A, a read end A side radial flange portion 72B is formed, and at the front end thereof, a front end B side radial flange portion 72C is formed. On the other hand, a coil 72D is wound around the outer periphery of the cylindrical portion 72A. The coil 72D is terminated to a terminal 72E extending radially from the rear end side radial flange portion 72B.

Reference numeral 73 denotes a movable core which is constructed as set out below. Reference numeral 73A denotes a cylindrical portion. The cylindrical portion 73A has a conical valve head portion 73C at a tip end 73B thereof. Also, the cylindrical portion 73A has a radially extending flange portion 73D. In the movable core 73, a fuel flow path 73F extends from a rear end 73E of the cylindrical portion 73A to the tip end 73B and further extends in the radial direction for flowing fuel in the vicinity of a fuel metering valve portion formed by the valve seat 70J and the valve head 73C.

The components set forth above are assembled in the following manner. First, the movable core 73 is arranged within the movable core guide bore 70G via the larger diameter rear portion of the housing 70. At this time, the valve head portion 73C is arranged in contact with the valve seat 70J, and the annular flange portion 73D is disposed within the annular groove 70M. The width (length in the longitudinal direction) is set to be greater than the thickness of the annular flange portion 73D. Thus, a stroke of the movable core 73 to a fully open position of the fuel metering valve portion is determined by a difference between the width of the annular groove 70M and the thickness of the annular flange portion 73D.

Next, the coil bobbin 72 is disposed within the coil bobbin receptacle hole 70E. At this time, the terminal 72E is externally extended sidewardly from the housing 70.

Then, the annular flange 71A of the stationary core is inserted into the flange receptacle bore 70C and thus arranged above the shoulder 70D. At this time, the cylindrical core portion 71C is disposed within the cylindrical portion 72A of the coil bobbin 72. Also, between the cylindrical core portion 71C and the movable core 73, a movable core spring 73J is disposed in preloaded fashion. In such condition, the rear end 70A of the housing 70 is clamped inwardly toward the annular flange portion 71A.

Thus, the stationary core 71 and the coil bobbin 72 are fixedly arranged within the housing 70. However, the movable core 73 is movably arranged within the movable core guide bore 70G. At this position, the rear end 73E of the movable core 73 is placed in opposition to the tip end 71E of the stationary core 73. The valve head portion 73C is urged toward the valve seat 70J by means of the movable core spring 73J.

When current is not supplied to the coil 72D, no magnetic force is generated in a magnetic circuit formed by the stationary core 71, the housing 70 and the movable core 73. Therefore, the movable core 73 is urged toward the tip end B by a spring force of the movable core spring 73J so that the valve head portion 73 is seated on the valve seat 70J in closing position for closing the fuel metering Valve portion. Accordingly, the fuel supplied within the movable core guide bore 70G and reaching to the valve seat 70J from the fuel flow passage 71F of the stationary core 71 and the fuel flow passage 73F of the movable core 73, is shut-off at the fuel metering valve portion of the valve seat 70J and the valve head portion 73C. Therefore, no fuel is injected toward outside from the injection aperture 70L.

When current is supplied to the coil 72D, a magnetic force is generated within the magnetic circuit to draw the movable core 73 toward the stationary core 71 against the spring force of the movable core spring 73J. At the condition where the annular flange 73D of the movable core 73 is in contact with the rear end surface 70N of the annular groove 70M, motion of the movable core 73 toward the rear end A is stopped to open the fuel metering valve portion of the valve head portion 73C and the valve seat 70J. Accordingly, the fuel supplied into the movable core guide bore 70G via the fuel flow passages 71F and 73F passes the fuel metering valve portion and the fuel injection cavity 70K to be injected through the fuel injection aperture 70L.

The conventional fuel injection valve assembly constructed as set forth above has the following drawbacks.

(1) It is not possible to lower production cost of the housing. The housing is normally formed by forging, and a press reduction process, etc. However, in the foregoing construction, since the annular groove having greater diameter is located at the axially intermediate portion of the movable core guide bore, the foregoing process cannot be employed, and the production process can be complicated to make it difficult to improve production efficiency. On the other hand, it is important to form the annular groove with high precision since the axial width of the annular groove determines the stroke of the movable core at fully open position. Since the recessed groove is formed by expanding the diameter of the movable core guide bore, it is difficult to form the groove width with high precision. It is also difficult to measure the groove width. This is one of causes for degradation of production efficiency.

(2) It is not possible to lower production cost of the movable core. The diameter of the movable core is univocally determined by the area of the magnetic passage formed between the surface of the tip end of the cylindrical core portion of the stationary core and the surface of the read end of the movable core. For improved dynamic characteristics of the movable core, the diameter of the movable core should to be as small as possible. On the Other hand, at the intermediate portion of the cylindrical portion of the movable core, the annular flange portion extends radially outward. This inherently requires that the diameter of the material of the movable core before processing has to be greater than that external diameter of the annular flange portion. Thus, the cost of material for the movable core is increased. Furthermore, since the diameter of the cylindrical portion other than the annular flange portion has to be reduced for obtaining necessary magnetic passage area, the production cost of the movable core can be further increased.

(3) It is not possible to lower the cost of assembling the fuel injection valve assembly. To lower the cost of assembling the fuel injection valve assembly, it has been customary to automatically assemble the components with the housing by inserting them from one direction. However, in case of the conventional device described above, since the movable core has the annular flange portion extending radially outward, the movable core can not be simply inserted into the movable core guide bore. Accordingly, special arrangement is required in assembling the fuel injection valve assembly. Thus, automatic assembling by inserting the components from one direction is difficult. This increases assembling cost.

(4) It is not possible to satisfy both the requirements for dynamic characteristics and durability of the movable core. The cylindrical portion of the movable core is formed to have constant diameter through the entire length from the rear end to the tip end, and, on the outer periphery of the cylindrical portion of the movable core in the vicinity of the tip end thereof, fuel flow conduits are opened. The fuel flowing from the fuel flow conduits flows toward the fuel metering valve portion constituted by the valve seat and the valve head portion with an annular gap between the outer periphery of the cylindrical portion at the tip end side of the movable core and the inner periphery of the movable core guide bore at the tip end side. In order to permit the fuel to flow, the annular gap between the outer periphery of the cylindrical portion at the tip end side of the movable core and the inner periphery of the movable core guide bore at the tip end side has to be greater than or equal to 1 mm. Then, an identical annular gap is inherently formed between the outer periphery of the cylindrical portion at the rear end side of the movable core and the inner periphery of the movable core guide bore at the rear end side. Such relatively large gap at the rear end side permits tilting of the movable core to cause local contact between the outer periphery of the movable core and the inner periphery of the movable core guide bore to cause friction force serving as resistance for smooth axial movement of the movable core. Also, reciprocation of the movable core while maintaining local contact between the outer periphery of the movable core and the inner periphery of the movable core guide bore should cause wearing of the contacting portion to make it difficult to stably control fuel for a long period. It should be noted that, in order to prevent tilting of the movable core, the gap between the between the outer periphery of the movable core and the inner periphery of the movable core guide bore has to be quite small, i.e., on the order of 10 μm.

SUMMARY OF THE INVENTION

The present invention has been developed in view of the problem set forth above. It is therefore an object of the present invention to provide a fuel injection valve assembly which can be produced with lower cost of the major components and that can be easily assembled so as to provide an inexpensive fuel injection valve assembly.

Another object of the present invention is to provide a fuel injection valve assembly which can achieve satisfactory high dynamic characteristics and durability.

In order to accomplish and other objects, according to one aspect of the invention, an electromagnetic fuel injection valve assembly comprising:

a housing coaxially defining a flange receptacle bore of a large diameter, a coil bobbin receptacle bore of a medium diameter, a movable core guide bore of a small diameter, a conical valve seat having smaller diameter than that of the movable core guide bore and a fuel injection cavity having smaller diameter than the valve seat, in order from a rear end to a tip end;

a stationary core having an annular flange portion to be inserted into the flange receptacle bore of the housing, a fuel induction cylinder portion projecting from the annular flange portion to the rear end, a cylindrical core portion projecting from the annular flange portion to the tip end, a fuel passage defined from the rear end of the fuel induction cylinder portion to the tip end of the cylindrical core portion, and a terminal insertion hole defined perpendicularly to the annular flange portion;

a coil bobbin having a coil wound around the outer periphery of a cylindrical portion and a terminal connected to the coil and extending from the rear end side flange portion of the cylindrical portion toward the rear end;

a movable core having a cylindrical portion movably arranged within the movable core guide bore, a smaller diameter cylindrical stem portion 4C extending from a tip end of the cylindrical stem portion toward the tip end of sad housing and having smaller diameter than that of the cylindrical stem portion, a conical valve head portion extended from a tip end of the smaller diameter cylindrical portion toward the tip end of the housing and a fuel flow passage defined from a rear end of the cylindrical stem portion toward the smaller diameter cylindrical portion and opening to an outer periphery of the smaller diameter cylindrical portion;

the annular flange portion of the stationary core being disposed within the flange receptacle bore, the cylindrical core portion being extended into the coil bobbin receptacle bore of the housing;

the coil bobbin being disposed between the coil receptacle bore of the housing and the outer periphery of the cylindrical core portion, the terminal being extended rearwardly from the rear end of the housing through a terminal insertion hole defined in the annular flange portion of the stationary core, the cylindrical stem portion of the movable core being movably arranged within the movable core guide bore with opposing the rear end thereof with the tip end of the cylindrical core portion of the stationary core and opposing the conical valve head portion to the valve seat, and a movable core spring being arranged between the movable core and an inner collar which is arranged within the fuel passage of the housing in pre-loaded fashion, the valve head portion being seated on the valve seat and a gap corresponding to a fully open stroke of the movable core being defined between the rear end of the movable core and the tip end of the cylindrical core portion.

In the preferred construction, a liquid state bond is applied between the flange receptacle bore of the housing and the outer periphery of the annular flange portion of the stationary core, and between the terminal insertion hole of the annular flange portion and the outer periphery of the terminal, and subsequently, the rear end of the housing is clamped radially inward toward the annular flange portion. In the alternative, the liquid state bond is applied between the flange receptacle bore and the outer periphery of the annular flange portion of the stationary core and between the terminal insertion hole of the annular flange and the outer periphery of the terminal.

The fuel injection cavity defined in the housing may be a hemisphere shaped configuration. A wall thickness of the hemispherical fuel injection cavity may be less than or equal to 0.5 mm, and a fuel injection aperture may be formed substantially perpendicularly to the hemisphere surface of the fuel injection cavity. A plurality of the fuel injection apertures may be arranged in circumferential alignment about the center of the hemisphere. Also, a given number of the fuel injection apertures may be arranged at a regular interval to form a fuel injection aperture group, and a plurality of fuel injection aperture groups may be arranged along the circumference about the center of the hemisphere.

The electromagnetic fuel injection valve assembly may further comprise a protective cylindrical portion provided on the tip end of the housing, the protective cylindrical portion extending toward the tip end of the housing beyond the fuel injection cavity and surrounding the outer periphery of the fuel injection cavity.

Also, a ring-shaped groove may be defined on the outer periphery of the annular flange portion of the stationary core. Alternatively, a plurality of vertically extending grooves extending from the tip end of the cylindrical stem portion to the portion in the vicinity of the rear end of the cylindrical stem portion may be formed on the outer periphery of the cylindrical stem portion.

The electromagnetic fuel injection valve assembly may further comprise a hemisphere-shaped projection formed integrally with the valve head portion of the movable core and extending from the tip end of the valve head portion, the hemisphere-shaped projection having a shape that is substantially complementary with that of the fuel injection cavity for defining a substantially uniform hemisphere-shaped fine gap therebetween.

With the construction described above, since the flange receptacle bore, the coil bobbin receptacle bore, the movable core guide bore, the valve seat and the fuel injection cavity are coaxially arranged within the housing with reducing respective diameter in order, manufacture of the housing is facilitated. Also, the cylindrical stem portion of the movable core can be selected to have the minimum possible diameter satisfying the requirement for the magnetic path area and have no larger diameter portion, thereby reducing material cost of the movable core. Furthermore, since the movable core, the coil bobbin and the stationary core are sequentially inserted into the housing and since the terminal can be inserted through the terminal receptacle hole, the fuel injection valve assembly can be easily assembled. Thus, the production cost of the fuel injection valve assembly can be lowered. Also, the cylindrical stem portion of the movable core is movably guided with a fine clearance with the inner periphery of the movable core guide bore, tilting of the movable core can be restricted to improve dynamic characteristics and durability.

On the other hand, since the liquid state bond is applied between the flange receptacle bore of the housing and the outer periphery of the annular flange portion of the stationary core, and between the terminal insertion hole of the annular flange portion and the outer periphery of the terminal, and subsequently, the rear end of the housing is clamped radially inward toward the annular flange portion, a seal in the gap portion can be securely maintained without requiring special sealing material. Thus, workability in assembling can be significantly improved to contribute to lowering of the production cost.

In the alternative, since the liquid state bond is applied between the flange receptacle bore and the outer periphery of the annular flange portion of the stationary core and between the terminal insertion hole of the annular flange and the outer periphery of the terminal, a seal in the gap portion can be certainly maintained without requiring special sealing material. Furthermore, since the inner periphery of the flange receptacle bore and the outer periphery of the annular flange are fixedly bonded, clamping the rear end of the housing radially inward toward the annular flange portion is facilitate. This makes assembly even easier contributing to lowering of the production cost.

Also, since the fuel injection aperture is formed perpendicularly to the hemisphere-shaped fuel injection cavity having wall thickness of less than or equal to 0.5 mm, the fuel injection aperture having a quite fine diameter can be made quite accurately and satisfactorily.

Since a plurality of said fuel injection apertures are arranged in circumferential alignment about the center of the hemisphere, fuel can be injected from respective fuel injection apertures in oblique direction. Thus, finely atomized fuel may form conical spray configuration.

Since a given number of fuel injection apertures are arranged at a regular interval to form a fuel injection aperture group, and a plurality of fuel injection aperture groups are arranged along the circumference about the center of the hemisphere, a conical spray of atomized fuel can be injected toward one predetermined direction from one fuel injection aperture group. Also, a conical spray of atomized fuel can be injected toward the other predetermined direction from another fuel injection aperture group.

This is suitable as the fuel injection valve assembly in a multi-induction type engine having a plurality of suction valves.

The electromagnetic fuel injection valve assembly further comprises a protective cylindrical portion provided on the tip end of said housing. The protective cylindrical portion extends toward the tip end of said housing beyond said fuel injection cavity and surrounds the outer periphery of said fuel injection cavity. Thus, the fuel injection aperture can be protected. Therefore, the fuel injection aperture can be certainly protected upon production of the fuel injection valve assembly and in loading on the engine. Furthermore, deposition of the deposit on the fuel injection aperture can be effectively restricted.

By depressing the annular flange portion from the rear end side toward the tip end side after insertion of the annular flange portion of the stationary core into the flange receptacle bore of the housing, the ring groove is crushed to permit accurate adjustment of the fully open stroke of the movable core.

By providing the vertical groove, the movable core can be supported a centered position without varying the sliding gap in the longitudinal direction between the outer periphery of the cylindrical stem portion of the movable core and the movable core guide bore. Furthermore, sliding resistance between the outer periphery of the cylindrical stem portion of the movable core and the movable core guide bore is reduced. Thus, dynamic characteristics of the movable core and toughness of movable core in biting of the foreign matter is improved.

Upon closure of a fuel metering valve portion formed by the valve head portion of the movable core and the valve seat, the volume of the chamber of the fuel injection cavity can be effectively reduced. Therefore, after-dripping of the fuel (upon stopping fuel injection) and deposition of deposits on the fuel injection aperture are effectively reduced.

BRIEF DESCRIPTION OF THE DRAWINGS

The present invention will be understood more fully from the detailed description given herebelow and from the accompanying drawings of the preferred embodiments of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of preferred embodiments with reference to the accompanying drawings, particularly to FIGS. 1 to 8. In the following description, numerous specific details are set forth in order to provide a thorough understanding of the present invention. It will be obvious, however, to those skilled in the art that the present invention may be practiced without these specific details. In other instances, well-known structures are not shown in detail in to not unnecessary obscure the present invention.

Figure 1:
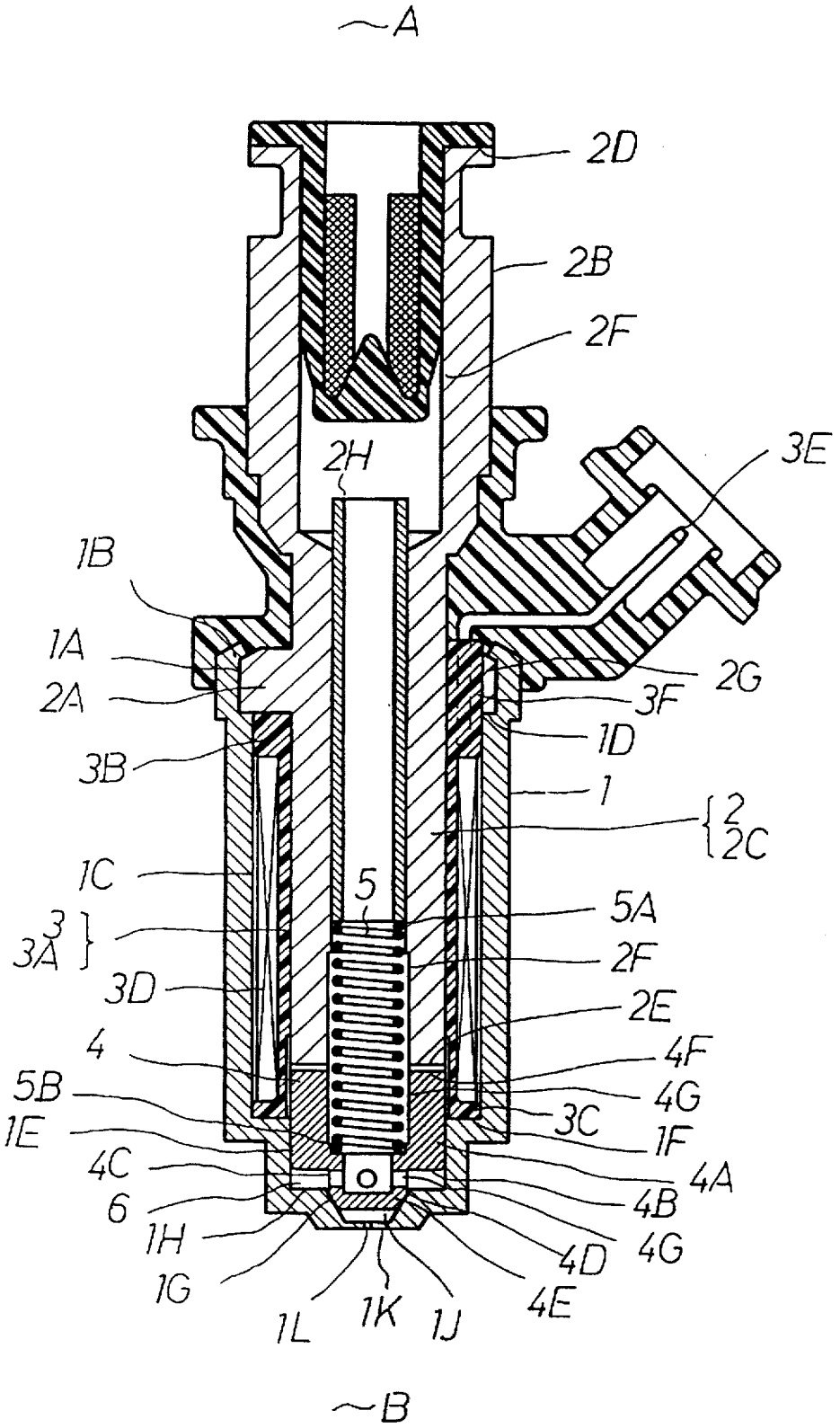
FIG. 1 is a longitudinal section showing the first embodiment of an electromagnetic fuel injection valve assembly according to the present invention.

The first embodiment of a fuel injection valve assembly according to the present invention will be discussed with reference to FIG. 1. The reference numeral 1 denotes a housing formed of a magnetic material, 1A denotes a large diameter flange receptacle bore opening toward the rear end 1B of the housing 1. 1C denotes a coil bobbin receptacle bore continuous with the large diameter flange receptacle bore across a stepped portion 1D and extends toward a tip end B. The diameter of the coil bobbin receptacle bore 1C is smaller than the diameter of the flange receptacle bore 1A. The diameter of the coil bobbin receptacle bore 1C will be referred to hereinafter as "medium diameter). 1E denotes a movable coil guide bore continuous to the coil bobbin receptacle bore 1C across a stepped portion 1F and has a diameter smaller than the diameter of the coil bobbin receptacle bore 1C. 1G denotes a valve seat of truncated conical-shaped configuration. The valve seat 1G is continuous to the movable core guide bore 1E across a stepped portion 1H. The largest diameter of the truncated conical valve seat 1G is smaller than the diameter of the movable core guide bore 1E. 1J denotes a fuel injection cavity formed as extension of the truncated conical valve seat 1G toward the tip end 1K.

Namely, within the housing 1, the flange receptacle bore 1A, the coil bobbin receptacle bore 1C, the movable core guide bore 1E, the valve seat 1G and the fuel injection cavity. 1J are coaxially arranged from the rear end 1B to the tip end 1K. Furthermore, the diameters of respective bores are gradually reduced from the rear end 1B to the tip end 1K. Also, a fuel injection conduit 1L communicated with the fuel injection cavity 1J and opening to the tip end 1K of the housing 1, is formed.

A stationary core 2 is formed of a magnetic material, and constructed as follow. The reference numeral 2A denotes an annular flange portion inserted into the flange receptacle bore 1A. From the annular flange portion 2A, a fuel introduction cylindrical portion 2B is extended toward the rear end A. Also, a cylindrical core portion 2C entering into the coil bobbin receptacle bore 1C is extended from the annular flange portion 2A toward the tip end B. A fuel passage 2F is formed from the read end 2D to the tip end 2E through the fuel introduction cylindrical portion 2B. On the other hand, in the annular flange portion 2A, a terminal insertion hole 2G is formed in a direction perpendicularly to the annular flange portion 2A. In other words, the terminal insertion hole 2G is formed along the longitudinal axis of the stationary core 2. It should be noted that 2H denotes a pipe-shaped inner collar arranged within the fuel passage 2F by way of press fitting.

A coil bobbin 3 is formed of a synthetic resin material. 3A denotes a cylindrical portion formed with a through hole therein. An annular rear end side flange portion 3B is formed at the rear end A side of the cylindrical portion 3A. An annular tip end side flange portion 3C is formed at the tip end B side. A coil 3D is wound around the outer periphery of the cylindrical portion 3A. On the rear end side flange portion 3B, a terminal 3E oriented toward the read end A is provided. The terminal 3E is connected to the coil 3D. As shown, the terminal 3E is implanted in a terminal post 3F extending toward the rear end A side from the rear end side flange portion 3B. Before assembling the coil bobbin 3 within the housing 1, the terminal 3E extends substantially perpendicularly toward the rear end A.

A movable core 4 is formed of a magnetic material. 4A denotes a cylindrical portion movably arranged with a fine gap in the order of 10 μm, for example, with respect to the movable core guide bore 1E. From the tip end 4B of the cylindrical portion 4A, a small diameter cylindrical portion 4C having sufficiently smaller diameter than the diameter of the cylindrical portion 4A, is extended toward the tip end B. A truncated conical valve head portion 4E is formed at the tip end B side of the tip end 4D of the small diameter cylindrical portion 4C. Cylindrical portion 4A, the small diameter cylindrical portion 4C and the valve head portion 4E are coaxially formed in series. From the rear end 4F of the cylindrical portion 4A, a fuel passage 4G is formed toward the small diameter cylindrical portion 4C. The downstream of the fuel passage 4G opens to the outer periphery of the small diameter cylindrical portion 4C.

The first embodiment of the fuel injection valve assembly, according to the present invention is assembled in the following manner. From the opening at the rear end 1B of the housing 1, the movable core 4 having a movable core spring 5 of a coil spring within the fuel passage 4G is inserted into the movable core guide bore 1E of the housing 1 from the opening at the rear end 1B of the housing 1. By this, the cylindrical portion 4A and the small diameter cylindrical portion 4C of the movable core 4 are arranged within the movable core guide bore 1E. Then, the valve head portion 4E is arranged in opposition to the valve seat 1G.

Next, the coil bobbin 3 is inserted into the coil bobbin receptacle bore 1C from the opening of the rear end 1B. By this, the tip end side flange portion 3C of the coil bobbin 3 is abutted onto the stepped portion 1F, and the a part of the outer periphery at the read end 4F side of the cylindrical portion 4A of the movable core 4 is arranged in opposition within the cylindrical portion 3A of the coil bobbin 3.

Next, the annular flange portion 2A of the stationary core 2 is inserted within the flange receptacle bore 1A of the housing 1 from the opening at the rear end 1B. The annular flange portion 2A is abutted on the stepped portion 1D of the flange receptacle bore 1A. The cylindrical core portion 2C is arranged within the cylindrical portion 3A of the coil bobbin 3. Furthermore, the terminal 3E including the terminal boss 3F of the coil bobbin 3 is arranged to project toward the rear end A through the terminal insertion hole 2G of the annular flange portion 2A. In such condition, the rear end 5A of the movable core spring is abutted on the tip end of the inner collar 2H. Thus, the movable core 4 is urged toward the tip end B by the spring force of the movable core spring 5. The valve head portion 4E abuts against the valve seat 1G. Then, a gap corresponding to the fully open stroke of the movable core 4 is defined between the rear end 4F of the cylindrical portion 4A of the movable core 4 and the tip end 2E of the cylindrical core portion 2C of the stationary core 2 opposing to the former.

After thus arranging the movable core 4, the coil bobbin 3, the movable core spring 5 and the stationary core 2 within the housing, the rear end 1B of the housing 1 is clamped radially inward toward the annular flange portion 2A of the stationary core 2. Thus, respective components set forth above are retained within the housing 1.

Then, the terminal 3E extending toward rear end A beyond the rear end 1B of the housing 1 is bent in the desired direction. Thereafter, by way of out molding of a synthetic resin material, a coupler on the outer periphery of the rear end 1B of the housing 1 and a part of the outer periphery of the fuel introduction cylinder portion 2B are surround together with a coupler for the terminal 3E, in integral fashion. Thus assembling of the fuel injection valve assembly can be completed.

Fuel supplied into the fuel passage 2F of the fuel introduction cylindrical portion 2B reaches the fuel passage 4G of the movable core 4 via the fuel passage 2F of the cylindrical core portion 2C. The fuel within the fuel passage 4G reaches an annular fuel passage 6 defined by the small diameter cylindrical portion 4C of the movable core 4 and the movable core guide bore 1E. While a current is not supplied to the coil 3D, the valve head portion 4E is seated on the valve seat 1G to maintaining the fuel metering valve portion defined therebetween in shut-off position. Therefore, no fuel is injected through the fuel injection aperture 11.

On the other hand, when the current is supplied to the coil 3D via the terminal 3E, a magnetic force is generated in the magnetic circuit formed by the housing 1, the movable core 4 and the stationary core 2. By the magnetic force thus generated, the movable core 4 is drawn toward the stationary core 2 against the spring force of the movable core spring 5. Then, the rear end 4F of the movable core 4 abuts onto the tip end 2E of the cylindrical core portion 2 to release the valve head portion 4E from the valve seat 1G and whereby the fuel metering valve is opened to introduce the fuel into the fuel injection cavity. Then, the controlled amount of fuel is injected through the fuel injection aperture 1L.

By the shown embodiment of the fuel injection valve, (1) a production cost of the housing 1 can be lowered. Namely, in the housing, the flange portion receptacle bore 1A, the coil bobbin receptacle bore 1C, the movable core guide bore 1E, the valve seat 1G and the fuel injection cavity 1J are formed in continuous fashion, in order from the rear end 1B to the tip end 1K, and the diameters of respective bores are gradually reduced from the rear end 1B to the tip end 1K. Thus, the housing 1 can be formed in simple process such as forging, press reduction process or so forth to lower the production cost of the housing.

Machining may be performed for the movable core guide bore 1E and the valve seat G which are must have high precision in the bore diameter and improvement of the surface roughness. In such case, since the guide hole has already been formed by forging or so forth, machining thickness as can be quite small. Therefore, such machining will not significantly affect for lowering of the production cost.

On the other hand, the fully open stroke of the movable core 4 is defined by a gap between the rear end 4F of the movable core 4 and the tip end 2E of the cylindrical core portion 2C. Therefore, it is not necessary to provide a recessed groove for controlling the fully open stroke of the movable core within the peripheral wall of the housing 1. Thus, productivity of the housing can be significantly improved. (2) The production cost of the movable core 4 can be lowered. The diameter of the movable core 4 is determined depending upon the magnetic path area formed between the surface of the tip end 2E of the cylindrical core portion 2C and the rear end 4F thereof. In view of improvement of the dynamic characteristics of the movable core 4 with reduction of the weight as light as possible, the diameter of the movable core 4 is selected at possible smallest diameter. In case of the movable core to be employed in the shown embodiment, no flange portion extends radially outward for controlling the fully open stroke of the movable core, the diameter of the movable core 4 can be minimum while still satisfying the requirement for the magnetic path area. Accordingly, the diameter of the elemental material of the movable core 4 can be slightly greater than the diameter of the cylindrical portion 4A of the movable core 4. Therefore, in case of the movable core to be formed of a relatively expensive material, such as magnetic stainless steel material or so forth, material cost can be lowered to contribute for reduction of the production cost.

On the other hand, the small diameter cylindrical portion 4C formed at the tip end B side of the cylindrical portion 4A is formed to have smaller diameter than that of the cylindrical portion 4. Therefore, the smaller diameter cylindrical portion 4C never affects selection of the diameter of the cylindrical portion. Also, the smaller diameter cylindrical portion 4C may contribute for reduction of the weight of the movable core 4. (3) It is also possible to reduce assembling cost of the fuel injection valve assembly. Assembling of the fuel injection valve assembly is performed by disposing the movable core 4, the movable core spring 5, and the coil bobbin 5 into the housing 1 through the flange receptacle bore portion 1A. Subsequently, the annular flange portion 2A is inserted into the flange receptacle bore 1A with inserting the terminal 3E including a terminal boss 3F of the coil bobbin 3 into a terminal insertion hole 2G of the annular flange portion 2A of the stationary core 2. Then, the rear end 1B of the housing 1 is clamped radially inward toward the annular flange portion 2A. With the construction set forth above, since respective components are inserted in the same orientation within the housing 1 from the rear end A to the tip end B, automatic assembling can be easily performed. Accordingly, assembling can be facilitated to significantly reduce assembling cost.

As set forth above, since the production cost of the housing 1 can be lowered, the production cost of the movable core 4 can be lowered and the assembling cost of the fuel injection valve assembly can be lowered, overall production cost of the fuel injection valve assembly can be significantly lowered.

On the other hand, the movable core 4 is formed with the cylindrical portion 4A of larger diameter and the smaller diameter cylindrical portion 4C located at the tip end B side of the cylindrical portion 4A and having smaller diameter. Therefore, the cylindrical portion 4A can be movably guided within the movable core guide bore 1E, and the smaller diameter cylindrical portion 4C can be placed within the annular fuel passage 6 having a large annular gap defined by the movable core guide bore 1E. As set forth above, the gap between the cylindrical portion 4A and the movable core guide bore 1E can be set at fine gap of approximately 10 μm, for example, irrespective of the dimensions of other components.

By supporting the cylindrical portion 4A of the movable core 4 with a quite fine gap by the movable core guide bore 1E, tilting of the movable core 4 in reciprocating action can be completely avoided. Thus, the movable core 4 can smoothly act to improve dynamic characteristics. On the other hand, by avoidance of tilting of the movable core 4, there will never be a local collision between the movable core 4 and the movable core guide bore 1E. Therefore, wearing of the movable core 4 and the movable core guide bore 1E can be minimized and stable fuel control can be performed over a long period of time.

On the other hand, the fuel within the fuel passage 4G of the movable core 4 can be supplied into the annular fuel passage 6 from the fuel passage 4G opening to the outer periphery of the smaller diameter cylindrical portion 4C. Therefore, fuel supply toward the fuel metering valve portion will never be interfered and thus can be smoothly performed.

Then, in assembling, the flange receptacle bore 1A, the annular flange portion 2A, the terminal insertion bore 2G and the terminal boss 3F at the rear end 1B of the housing 1 can be maintained with a seal. This prevents internal fuel from externally leaking. The present invention proposes the following construction for maintaining seal.

At first, a liquid state bond can be employed. The liquid state bond is a single liquid type silicon denaturated polymer base bond, denaturated silicon epoxy matrix type bond or dual liquid type denaturated silicon epoxy matrix type bond or so forth can be employed. The set article of the liquid state bond has a bonding ability and becomes a rubber-like elastic body after application on a bonding portion and setting thereon.

Then, from the opening at the rear end 1B of the housing 1, the liquid state bond is applied into the gap between the flange receptacle bore 1A and the outer periphery of the annular flange portion 2A of the stationary core 2 and the gap between the terminal insertion hole 2G of the annular flange portion 2A and the outer periphery of the terminal boss 3F of the coil bobbin 3. Since the bond is in liquid state, the bond penetrates over the entire area in the gap and set therein. As set forth above, the gaps between the flange receptacle bore 1A and the annular flange portion 2A and between the terminal insertion hole 2G and the terminal boss 3F can be certainly sealed by the rubber-like elastic body. Thereafter, the rear end 1B of the housing 1 is clamped radially inward toward the annular flange portion 2A.

With the construction set forth above, it becomes unnecessary to provide sealing member, such as an O-ring, square-ring or so forth, arranged within the gap portion. Therefore, number of parts can be reduced and loading operation of such sealing member becomes unnecessary. This is effective for lowering of the production cost of the fuel injection valve assembly. Furthermore, it is possible to automatically meter the bond into the gap by employing a bond metering and ejecting device having a sun-and-planetary type rotor mechanism. Therefore, it becomes possible to automatically apply the bond.

Secondly, another liquid state bond is employed. The liquid state bond is a bond containing alkyl-α-cyanoacrylate as a primary component, a compound containing epoxy group or so forth. This type liquid state bond has a high bonding force by setting in quite short period.

Then, from the opening of the rear end 1B of the housing, the liquid state bond can be applied into the gap between the flange receptacle bore 1A and the outer periphery of the annular flange portion 2A of the stationary core 2 and between the gap between the terminal insertion hole 2G and the terminal boss 3F of the coil bobbin 3. Since the bond is in liquid state, the bond penetrates over the entire area in the gap and set therein. As set forth above, the gaps between the flange receptacle bore 1A and the annular flange portion 2A and between the terminal insertion hole 2G and the terminal boss 3F can be certainly sealed by the rubber-like elastic body and bonded at high bonding force.

With the construction set forth above, it becomes unnecessary to provide sealing member, such as an O-ring, square-ring or so forth, arranged within the gap portion. Therefore, number of parts can be reduced and loading operation of such sealing member becomes unnecessary. Furthermore, by bonding the gap portions with high bonding force, it becomes unnecessary to clamp the rear end 1B of the housing 1. Therefore, it becomes possible to further lower the production cost of the fuel injection valve assembly.

Figure 2:
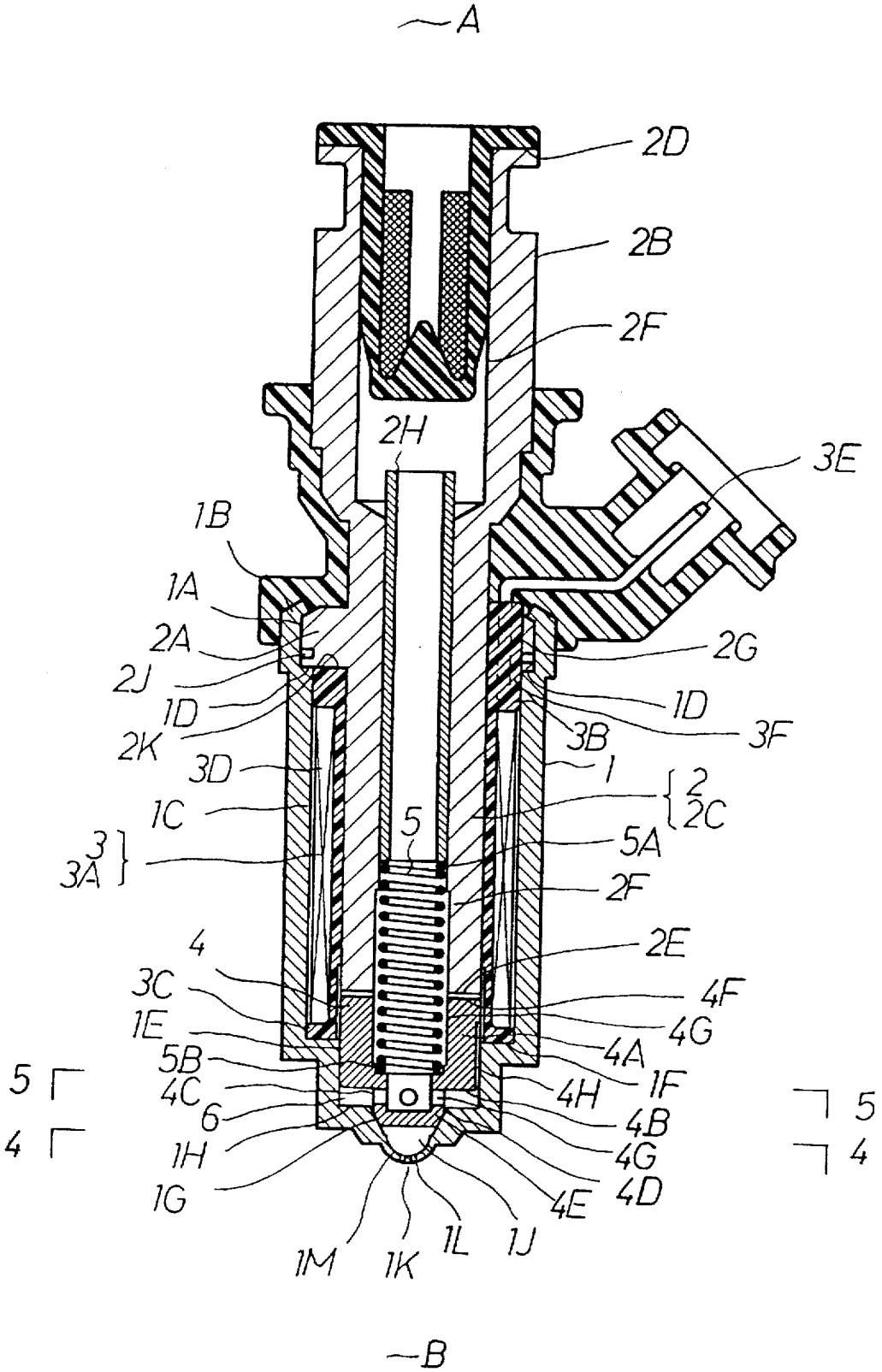
FIG. 2 is a longitudinal section showing the first embodiment of an electromagnetic fuel injection valve assembly according to the present invention.
Figure 3:
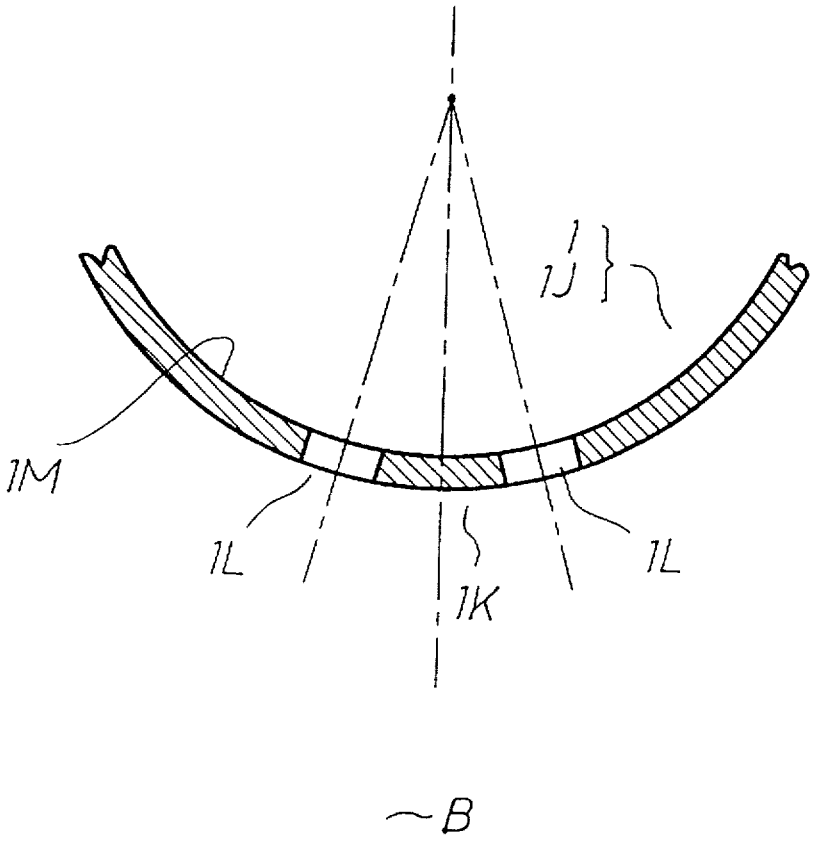
FIG. 3 is an enlarged illustration of a fuel injection cavity portion in the second embodiment of the fuel injection valve of FIG. 2.
Figure 4:
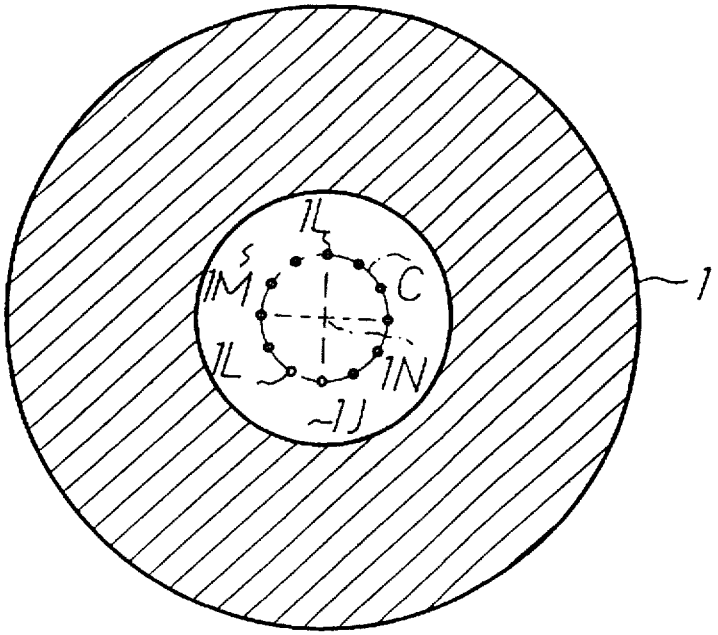
FIG. 4 is a cross section of one embodiment of the fuel injection conduit as taken along line 4—4 of FIG. 2.

The second embodiment of the fuel injection valve assembly according to the present invention will be discussed with reference to FIG. 2. In this embodiment, like components are represented by like reference numerals. The fuel injection cavity 1J formed at the tip end B side of the valve seat 1G of the housing is formed into a hemisphere-shaped configuration. The thickness of the fuel injection cavity 1J is less than or equal to 0.5 mm. Then, the fuel injection aperture 1L is formed substantially perpendicularly to the hemisphere surface 1M of the fuel injection cavity 1J. The hemisphere-shaped fuel injection cavity 1J including the fuel injection aperture is illustrated in enlarged fashion in FIG. 3.

With the construction as set forth above, the following particular effect can be achieved. (1) Since the fuel injection cavity 1J is formed into a hemisphere-shaped configuration, the wall thickness of the fuel injection cavity 1J is less than or equal to 0.5 mm, and the fuel injection aperture 1L is formed substantially perpendicular to the hemisphere surface 1M of the fuel injection cavity 1J, machining precision of the fuel injection hole 1 can be remarkably improved to make it possible to obtain accurate and uniform fuel atomization. Particularly, since the fuel injection aperture having quite fine diameter in the extent of 0.2 mm can be formed without edge loss. Thus, improvement of fuel atomization characteristics and improvement of fuel metering precision by the fuel injection aperture 1L can be achieved. (2) When fuel supply to the coil 3D is shut off, the valve head portion 4E is seated on the valve seat 1G to shut off the fuel metering valve. Thus, fuel supply into the fuel injection cavity via the fuel metering valve portion of the valve head portion 4E and the valve seat 1G is shut off. However, immediately before shutting off of the fuel metering valve portion, the fuel flows into the fuel injection cavity 1J by inertia. Then, the fuel flowing into the fuel injection cavity 1J concentrates at the tip end side of the hemisphere-shaped fuel injection cavity 1J and instantly ejected cavity 1J via the fuel ion cavity 1J via the fuel injection aperture 1L. As set forth above, a problem that the fuel retained in the fuel injection cavity is evaporated by atmospheric temperature of the engine to deposit gummy matter in the fuel in the vicinity of the fuel injection aperture 1L for causing reduction of the open area of the fuel injection aperture 1L, can be solved completely.

On the other hand, concerning the fuel injection aperture 1L, when a plurality of fuel injection apertures 1L are formed in alignment in the circumferential direction C about a center IN of the hemisphere fuel injection cavity 1J. Thus, the fuel can be effectively atomized into conical configuration (fuel injection aperture 1L is formed substantially perpendicularly to the hemisphere surface 1M). In the shown embodiment, twelve fuel injection apertures 1L of 0.3 mm diameter are formed on the circumferential direction C at 30° interval.

As set forth above, the fuel is injected relatively linearly toward oblique direction from respective fuel injection apertures 1L. By arranging a plurality of the fuel injection apertures along the circumference C, the conical fuel injected from respective fuel injection apertures is well mixed with the air for promoting atomization in comparison with the conical fuel injected from single fuel injection aperture. Thus, fuel supply characteristics for the engine is improved and whereby combustion ability of the engine can be improved.

Figure 5:
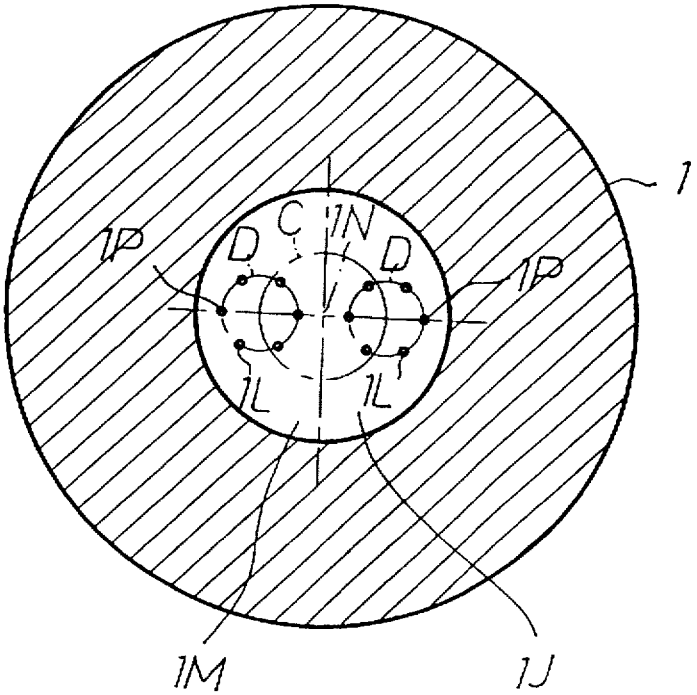
FIG. 5 is a cross section of another embodiment of the fuel injection conduit as taken along line 5—5 of FIG. 2.

Another arrangement of a plurality of fuel injection apertures is illustrated in FIG. 5. As shown in FIG. 5, a plurality of fuel injection apertures 1L are formed along a circle D to form one fuel injection aperture group 1P. When a plurality of fuel injection apertures groups 1P are formed in alignment in the circumferential direction C about a center IN of the hemisphere fuel injection cavity 1J. Thus, the fuel can be effectively atomized into conical configuration (fuel injection aperture 1L is formed substantially perpendicularly to the hemisphere surface 1M). In the shown embodiment, each fuel injection aperture group six fuel injection apertures arranged with 60° of angular interval, and two fuel injection aperture groups 1P are formed on the circle C with 180° of angular interval. In other words, one of the fuel injection aperture group 1P and the other fuel injection aperture group 1P are arranged symmetrically with respect to the center IN.

Fuel is injected relatively linearly toward oblique direction from respective fuel injection apertures groups 1P. By arranging a plurality of the fuel injection aperture groups along the circumference C, the conical fuels injected from respective fuel injection apertures groups in different directions. Such fuel injection valve assembly may be effectively employed in a multi-induction valve type engine. From one of the fuel injection aperture group 1P, the conical spray of fuel is accurately injected toward the first suction valve. From the other fuel injection aperture group 1P, the conical spray of fuel is accurately injected toward the second suction valve. In particular, in case of the multi-induction valve type engine, good engine performance can be attained. It should be noted that the number of the fuel injection apertures 1L and number of the fuel injection aperture groups may be appropriately or arbitrarily selected.

Figure 6:
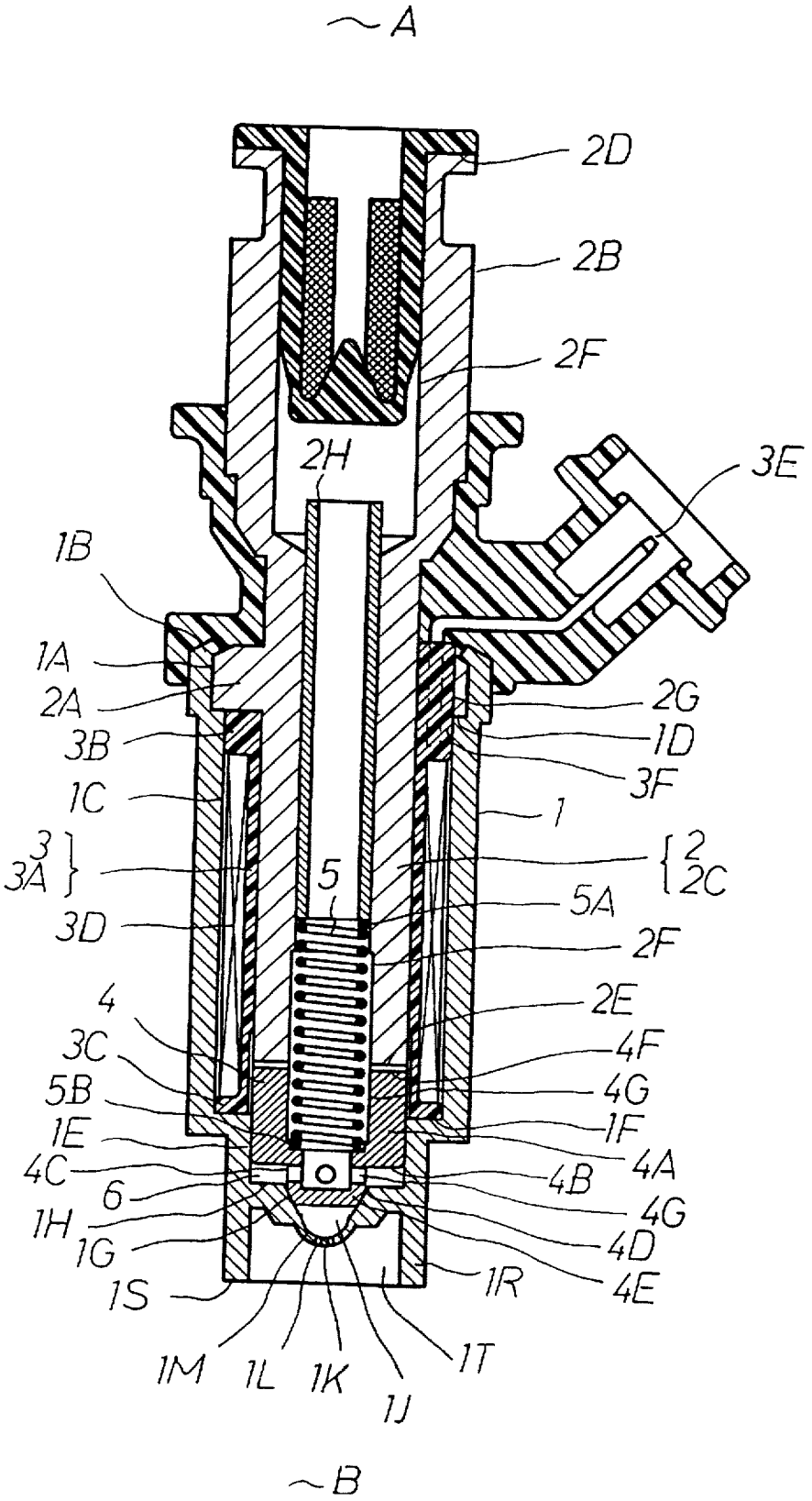
FIG. 6 is a longitudinal section showing the third embodiment of the fuel injection valve assembly according to the present invention.

The third embodiment of the fuel injection valve assembly according to the present invention will be discussed with reference to FIG. 6. In the following discussion, like reference numerals to those in FIG. 1 identify like components. A protective cylinder portion 1R is formed integrally with the housing 1, at the tip end B of the housing 1. The protective cylinder portion 1R surrounds the outer periphery of the fuel injection cavity and extends toward the tip end B from the tip end of the fuel injection cavity 1J. In other words, the tip end 1S of the protective cylinder portion 1R is extended beyond the tip end B from the fuel injection cavity for defining a protective space 1T within the protective cylinder portion 1R.

By providing the protective cylindrical portion 1R, during transportation of the fuel injection valve assembly, assembling operation and loading to the engine, possibility that the fuel injection aperture and the fuel injection cavity 1J are directly subject to external force, can be reduced and thus avoid possibility of damaging of the fuel injection aperture 1L and the fuel injection cavity 1J to certainly protect them. This is desirable from the viewpoint of quality assurance. On the other hand, it is known that gummy matter contained in a low quality fuel deposited on the circumference of the fuel injection aperture 1L together with dust in the air, make it difficult to open the fuel injection aperture 1L within a recessed portion of the protective cylindrical portion 1R. Here, in the shown embodiment, since the fuel injection aperture 1L is arranged with opening in the protective cylinder portion, the deposit effect can be efficiently avoided. Furthermore, it becomes unnecessary to prepare the cap of other material for forming the protective cylindrical portion 1R. The protective cylindrical portion can be formed simultaneously with formation of the housing.

The fourth embodiment of the fuel injection valve assembly according to the invention will be discussed with reference to FIG. 2. A ring groove 2J is formed on the outer periphery of the annular flange portion 2A of the stationary core 2. By providing the ring groove 2J, the ring groove 2J is deformed to reduce the groove width by application of the external force in the direction from the rear end A to the tip end B for the rear end surface of the annular flange portion 2A or the rear end 2D of the fuel induction cylindrical portion 2B, in the condition, where the annular flange portion 2A of the stationary core 2 is inserted into the flange receptacle bore 1A of the housing 1 and the tip end surface 2K of the annular flange portion 2A is abutted onto the stepped portion 1D of the flange receptacle bore 1A. As set forth above, the tip end 2E of the stationary cylindrical core portion 2C of the stationary core 2 is shifted toward the tip end B corresponding to the reduction amount of the recessed groove. Thus, the gap between the tip end 2E of the stationary cylindrical core portion 2C is reduced to permit adjustment of the magnitude of the fully open stroke of the movable core 4. On the other hand, the direction where the external force for the annular flange portion 2A acts, is the direction from the rear end A toward the tip end B and the same as the inserting direction of the parts into the housing. Therefore, the assembling operation can be automated.

Figure 7:
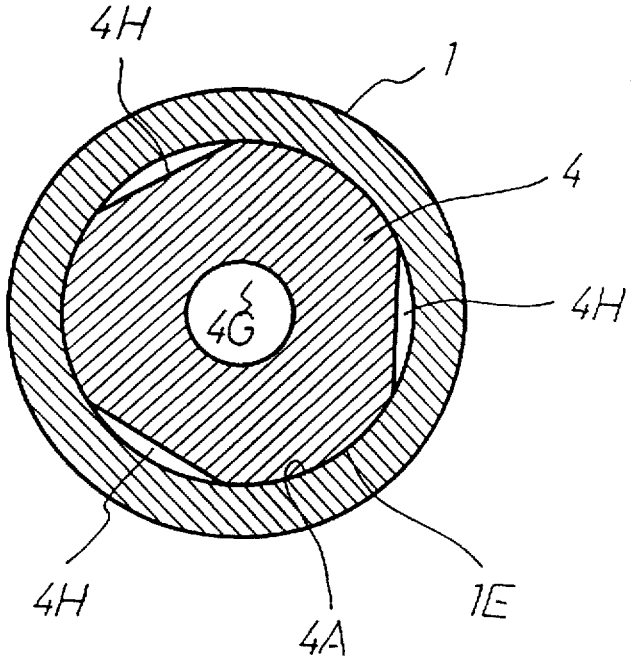
FIG. 7 is a cross section of one embodiment of a movable core as taken along line Y—Y of FIG. 2.

The fifth embodiment of the fuel injection valve assembly will be discussed with reference to FIGS. 2 and 7. The reference numeral 4H denotes a plurality of vertical grooves formed on the movable core 4. The vertical groove 4H extends from the tip end 4A of the cylindrical portion 4A to reach the position in the vicinity of the rear end 4F of the cylindrical portion. As can be seen, a plurality of vertical grooves 4H are formed on the outer periphery of the cylindrical portion. In the shown embodiment, three vertical grooves are formed with 120° of angular interval.

By providing the vertical groove 4H, sliding resistance between the cylindrical portion 4A and the movable core guide bore 1E guiding the former can be reduced to achieve improvement of the dynamic characteristics of the movable core 4. Also, within the annular fuel passage 6, fuel is supplied via the fuel passage 4G opening to the small diameter cylindrical portion 4C of the movable core 4. The fine foreign matter contained in the fuel in the annular fuel passage 6 tends to be retained in the portion of the tip end 4B of the cylindrical portion 4A opposing to the fuel passage 6 during reciprocal motion of the movable core 4. On the other hand, by opening the vertical grooves 4H to the tip end 4B of the cylindrical portion 4A, the foreign matter to be retained within the portion of the tip end 4B can penetrate into the vertical grooves 4H. Thus, introduction of the foreign matter into the fine gap between the cylindrical portion 4A and the movable core guide bore 1E can be restricted. Accordingly, good dynamic characteristics of the movable core 4 can be maintained for a long period. On the other hand, not forming the vertical grooves 4H to the rear end 4F of the cylindrical portion is preferred in viewpoint of reduction of the magnetic path area of the movable core 4 relative to the cylindrical core portion 2C.

Figure 8:
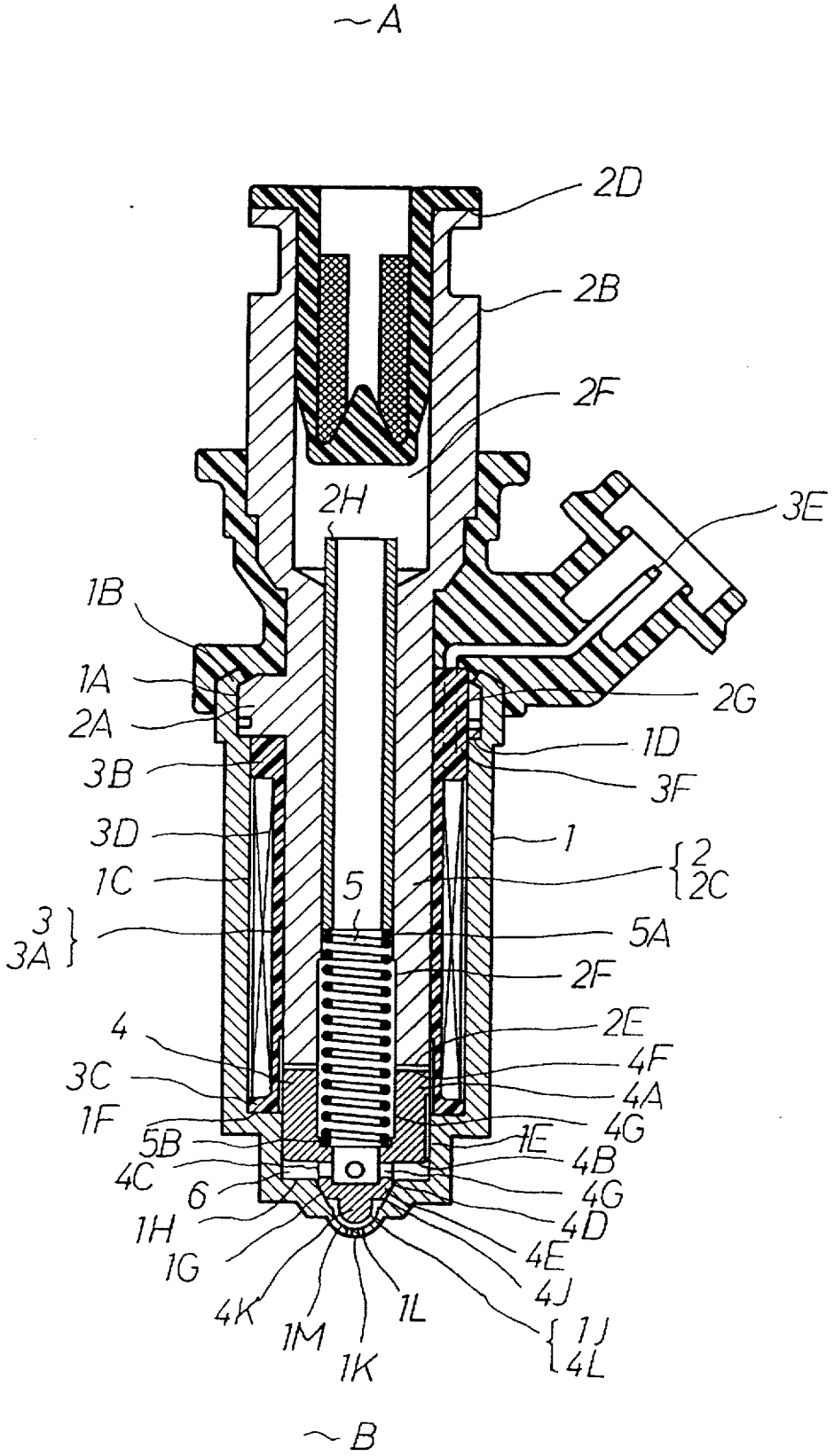
FIG. 8 is a longitudinal section showing the fourth embodiment of the fuel injection valve assembly according to the present invention.
Figure 9:
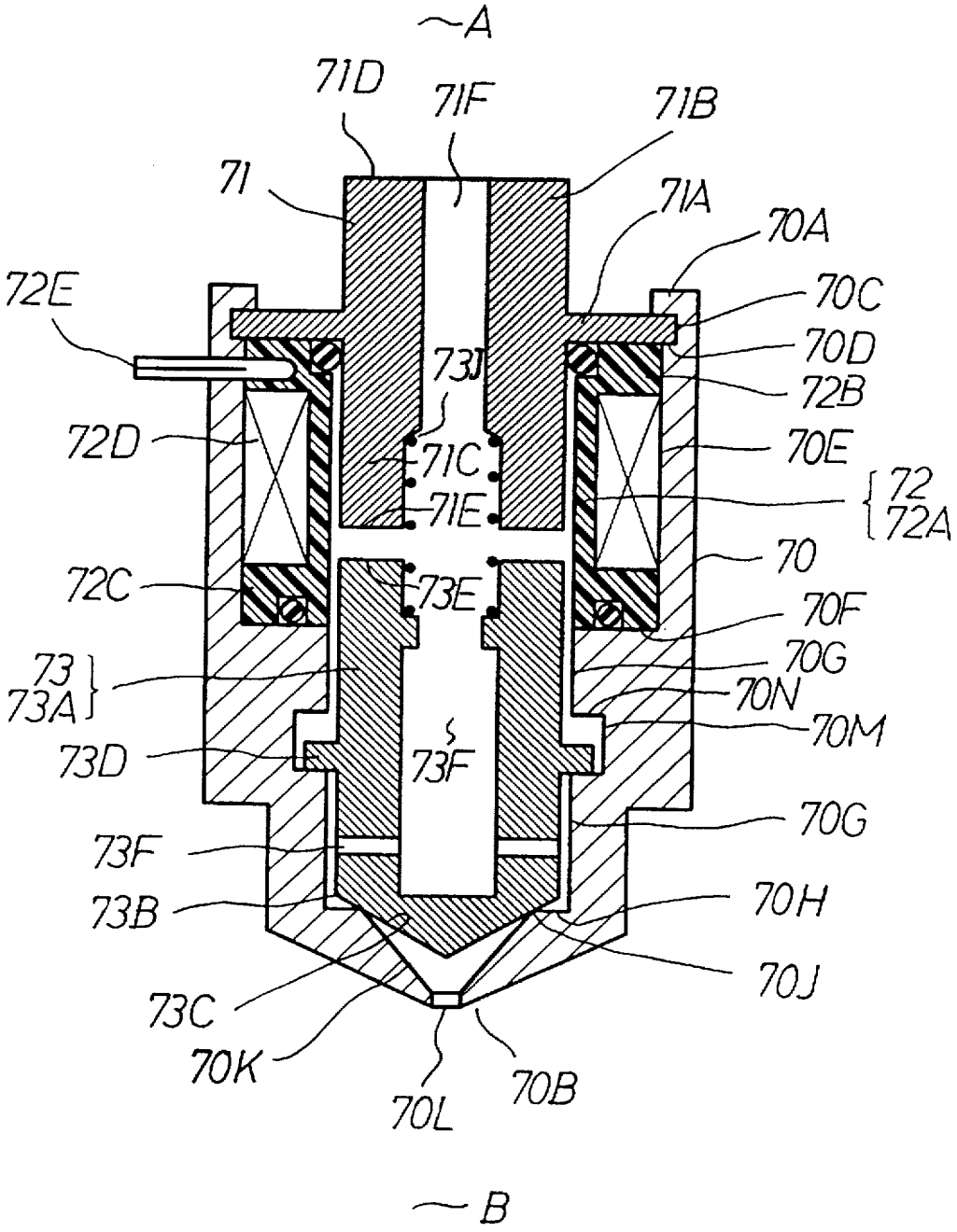
FIG. 9 (PRIOR ART)
FIG. 9 is a longitudinal section of the conventional (Prior Art) electromagnetic fuel injection valve assembly.

The sixth embodiment of the fuel injection valve assembly according to the present invention will be discussed with reference to FIG. 8. The shown embodiment has a hemisphere projection 4K to enter into the fuel injection cavity 1J, is integrally extended from the tip end 4J of the valve head portion 4E of the movable core 4 toward the tip end B. The hemisphere projection 4K is shaped into substantially complementary configuration to the hemisphere fuel injection cavity 1J. At the condition where the hemisphere projection 4K enters into the fuel injection cavity 1J, a substantially uniform hemisphere fine gap 4L is formed by the hemisphere projection 4K and the hemisphere surface 1M of the fuel injection cavity 1J. The hemisphere projection should not contact with the hemisphere surface 1M of the fuel injection cavity 1J. With the construction set forth above, the volume within the fuel injection cavity 1J corresponds to the volume of the hemisphere projection 4K to reduce the volume.

With the construction set forth above, the fuel introduced into the fuel injection cavity 1J via the fuel metering valve portion enters into a small volume chamber, a fuel pressure may not be lowered in the fuel injection cavity and can be injected through the fuel injection aperture 1L at an appropriate pressure. Thus, fuel with excellent atomizing characteristics can be supplied to the engine.

On the other hand, the hemisphere fine gap 4L defined by the hemisphere surface 1M of the fuel injection cavity 1J and the hemisphere projection 4K can have substantially uniform gap width. Therefore, when a plurality of fuel injection apertures 1L are formed, the fuel pressure to exerted upon respective fuel injection apertures 1L from the fine gap 4L becomes uniform. Thus, fuel amount to be injected from respective fuel injection apertures 1L can be made uniform.

Furthermore, since the volume of the fuel injection cavity becomes small, response of fuel supply through the fuel injection apertures 1L upon initiation of opening operation of the movable core 4 can be higher. On the other hand, upon closing of the movable core 4, after-dripping of fuel from the fuel injection cavity can be reduced. Also, when the valve head portion 4E of the movable core 4 abuts onto the valve seat 1G, fuel amount retained within the fuel injection cavity can be reduced. By this, deposition on the fuel injection aperture 1L can be reduced.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An electromagnetic fuel injection valve assembly comprising:

a housing coaxially defining a flange receptacle bore of a large diameter, a coil bobbin receptacle bore of a medium diameter, a movable core guide bore of a small diameter, a conical valve seat having smaller diameter than said movable core guide bore and a fuel injection cavity having smaller diameter than said valve seat, in order from a rear end to a tip end;

a stationary core having an annular flange portion to be inserted into said flange receptacle bore of said housing, a fuel induction cylinder portion projecting from said annular flange portion to the rear end, a cylindrical core portion projecting from said annular flange portion to said tip end, a fuel passage defined from the rear end of said fuel induction cylinder portion to the tip end of said cylindrical core portion, and a terminal insertion hole defined perpendicularly to said annular flange portion;

a coil bobbin having a coil wound around the outer periphery of a cylindrical portion and a terminal connected to said coil and extending from the rear end side flange portion of said cylindrical portion toward the rear end;

a movable core having a cylindrical portion movably arranged within said movable core guide bore, a smaller diameter cylindrical stem portion 4C extending from a tip end of said cylindrical stem portion toward said tip end of sad housing and having smaller diameter than that of said cylindrical stem portion, a conical valve head portion extended from a tip end of said smaller diameter cylindrical portion toward the tip end of said housing and a fuel flow passage defined from a rear end of said cylindrical stem portion toward said smaller diameter cylindrical portion and opening to an outer periphery of said smaller diameter cylindrical portion;

said annular flange portion of said stationary core being disposed within said flange receptacle bore, said cylindrical core portion being extended into said coil bobbin receptacle bore of said housing;

said coil bobbin being disposed between said coil receptacle bore of said housing and the outer periphery of said cylindrical core portion, said terminal being extended rearwardly from the rear end of said housing through a terminal insertion hole defined in said annular flange portion of said stationary core, said cylindrical stem portion of said movable core being movably arranged within said movable core guide bore with opposing the rear end thereof with the tip end of said cylindrical core portion of said stationary core and opposing said conical valve head portion to said valve seat, and a movable core spring being arranged between said movable core and an inner collar which is arranged within said fuel passage of said housing in pre-loaded fashion, said valve head portion being seated on said valve seat and a gap corresponding to a fully open stroke of said movable core being defined between the rear end of said movable core and the tip end of said cylindrical core portion.

2. An electromagnetic fuel injection valve assembly as set forth in claim 1, wherein a liquid state bond is applied between said flange receptacle bore of said housing and the outer periphery of said annular flange portion of said stationary core, and between the terminal insertion hole of said annular flange portion and the outer periphery of said terminal, and subsequently, said rear end of said housing is clamped radially inward toward said annular flange portion.

3. An electromagnetic fuel injection valve assembly as set forth in claim 1, wherein a liquid state bond is applied between said flange receptacle bore and the outer periphery of said annular flange portion of said stationary core and between said terminal insertion hole of said annular flange and the outer periphery of said terminal.

4. An electromagnetic fuel injection valve assembly as set forth in claim 1, wherein said fuel injection cavity defined in said housing is hemisphere shaped configuration and a wall thickness of said hemispherical fuel injection cavity is less than or equal to 0.5 mm, and a fuel injection aperture is formed substantially perpendicularly to said hemisphere surface of said fuel injection cavity.

5. An electromagnetic fuel injection valve assembly as set forth in claim 4, wherein a plurality of said fuel injection apertures are arranged in circumferential alignment about the center of the hemisphere.

6. An electromagnetic fuel injection valve assembly as set forth in claim 4, wherein a given number of said fuel injection apertures are arranged at a regular interval to form a fuel injection aperture group, and a plurality of fuel injection aperture groups are arranged along the circumference about the center of the hemisphere.

7. An electromagnetic fuel injection valve assembly as set forth in claim 1, which further comprises a protective cylindrical portion is provided on the tip end of said housing, said protective cylindrical portion being extending toward the tip end of said housing beyond said fuel injection cavity and surrounding the outer periphery of said fuel injection cavity.

8. An electromagnetic fuel injection valve assembly as set forth in claim 1, wherein a ring-shaped groove is defined on the outer periphery of said annular flange portion of said stationary core.

9. An electromagnetic fuel injection valve assembly as set forth in claim 1, wherein a plurality of vertically extending grooves extending from the tip end of said cylindrical stem portion to the portion in the vicinity of the rear end of said cylindrical stem portion are formed on the outer periphery of said cylindrical stem portion.

10. An electromagnetic fuel injection valve assembly as set forth in claim 4, which further comprises a hemisphere projection formed integrally with said valve head portion of said movable core and extending from the tip end of said valve head portion, said hemisphere projection being shaped into a substantially complementary shape with said fuel injection cavity for defining a substantially uniform hemisphere fine gap therebetween.

* * * * *